United States Patent [19]

Otsubo et al.

[11] 4,206,177

[45] Jun. 3, 1980

[54] EXHAUST SILENCER INCLUDING A CATALYST

[75] Inventors: Toyowo Otsubo; Takeo Fujita, both of Hamamatsu; Toshiyuki Kondo, Tenryu, all of Japan

[73] Assignee: Yamaha Hatsudoki Kabushiki Kaisha, Iwata, Japan

[21] Appl. No.: 875,551

[22] Filed: Feb. 6, 1978

[30] Foreign Application Priority Data

Feb. 9, 1977 [JP] Japan ..... 52-1465[U]

[51] Int. Cl.[2] ..... B01J 8/02; F01N 3/15

[52] U.S. Cl. ..... 422/171; 181/264; 422/176; 422/181

[58] Field of Search ..... 23/288 F, 288 FA; 60/299, 296; 181/264, 212, 213; 55/DIG. 30, 276; 422/171, 176, 181

[56] References Cited

U.S. PATENT DOCUMENTS

| | | | |
|---|---|---|---|
| 2,065,681 | 12/1936 | Fogas | 23/277 C |
| 2,234,612 | 3/1941 | Wold | 181/55 |
| 3,043,095 | 7/1962 | Strutz | 23/288 F |
| 3,460,916 | 8/1969 | Aronsohn | 422/171 |
| 3,687,637 | 8/1972 | Okamura | 23/288 FB |
| 3,757,892 | 9/1973 | Raudman, Jr. | 55/276 X |
| 3,989,471 | 11/1976 | Nowak | 60/299 X |
| 4,094,644 | 6/1978 | Wagner | 422/181 |
| 4,149,611 | 6/1979 | Taguchi | 181/252 |

FOREIGN PATENT DOCUMENTS 819461 8/1969 Canada .

*Primary Examiner*—Barry S. Richman
*Attorney, Agent, or Firm*—Donald D. Mon

[57] ABSTRACT

An exhaust silencer provided with a catalyst. It includes an expansion chamber with a reflecting wall, and a silencer chamber. A passage joins the two chambers, and a catalyst lies in the passage, preferably on the wall of a tube which forms the passage, where it covers perforations in the tube through which the exhaust gases must pass when they flow from one chamber to the other. An auxiliary catalyst can also be provided in the expansion chamber.

3 Claims, 3 Drawing Figures

EXHAUST SILENCER INCLUDING A CATALYST

The present invention relates to an exhaust silencer equipped with a catalyst for a reaction of the exhaust gas.

Generally speaking, the catalyst has to be located relatively far from the engine, so as not to overheat the catalyst during heavy load operation of the engine. Also, the catalyst requires a relatively large space to receive it. For these reasons, the catalyst is usually installed in the exhaust silencer.

In case of motorcycles, a reflection wall is provided at the intermediate portion of the exhaust silencer. The space at the fore side of the reflection wall is formed into an expansion chamber connected to the exhaust pipe, while the space at the rear side of the reflection wall is formed into a silencer chamber. The expansion chamber and the silencer chamber are communicated with each other by a communication passage or a pipe, so that the silencing function may be performed through an interference of pressure and through an expansion and compression of the gas while it passes through the communication passage or pipe.

In case that a catalyst is to be installed in an exhaust silencer of the kind described, the location of the catalyst involves some problems. Namely, assuming that the catalyst is located at an intermediate portion of the expansion chamber, it deteriorates the reflection of the pressure wave and thereby adversely affects the engine. Also, if the catalyst is located within the silencer chamber, the temperature of the exhaust gas is inconveniently lowered below the activating temperature of the catalyst as it passes through the communication passage and the expansion chamber, so as to cause an imperfect oxidation reaction of the exhaust gas.

It is therefore an object of the invention to provide an exhaust gas silencer having a catalyst capable of being sufficiently activated without adversely affecting the engine performance, thereby to overcome above described problems.

The above and other features of this invention will be fully understood from the following detailed description and the accompanying drawings, in which.

Figure 1:
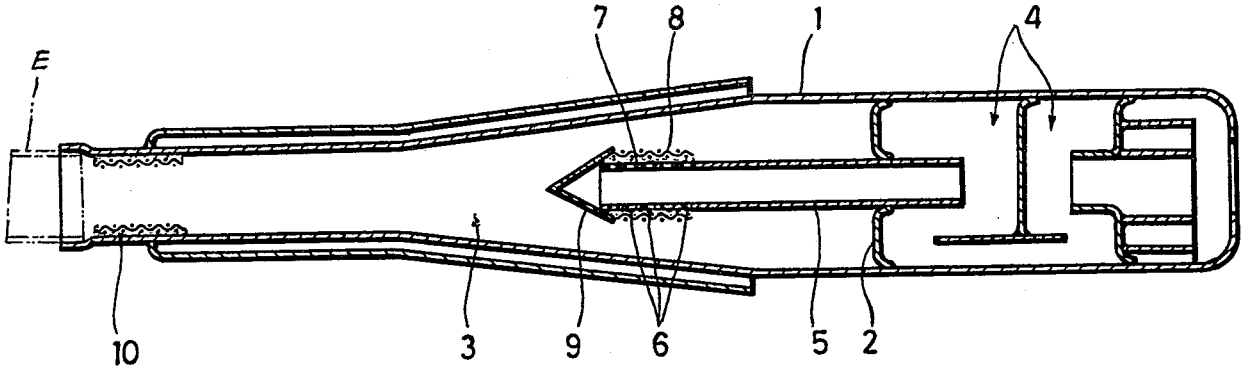
FIG. 1 is an axial cross-section of the presently preferred embodiment of the invention.

Referring to FIG. 1, a reflection wall 2 is provided at an intermediate portion of the space within an outer pipe 1 of the exhaust silencer. The space at the fore side of the reflecting wall is formed into an expansion chamber 3 connected to an exhaust pipe E leading from the engine, while the space at the rear side of the reflection wall 2 is formed into a silencer chamber 4.

A communication pipe 5 is provided to extend through the reflecting wall 2. The communication pipe 5 projects into the expansion chamber 3 and has a plurality of small bores 6 formed in the peripheral wall at the end portion thereof. A fibrous main catalyst 7 for causing the reaction of the exhaust gas is wound around the end portion of the communication pipe 5, and is covered with a gauze wire 8.

Figure 3:
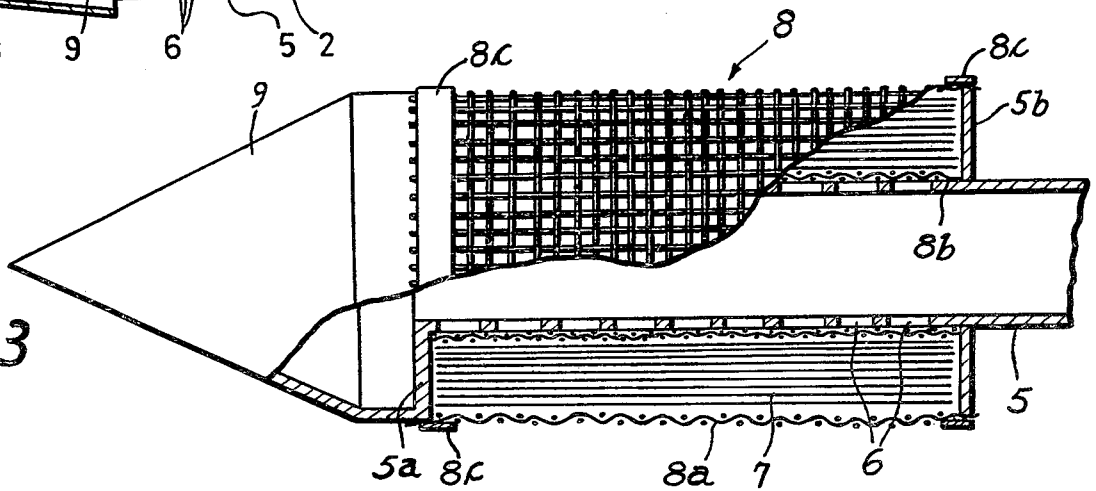
FIG. 3 is a partial sectional side elevational view of an essential part of the embodiment of FIG. 1.

As shown in FIG. 3, the main catalyst 7 consists of a sheet-like catalyst element having a heat resistant carrier sheet made of textile or non-textile fabric and a catalyst attached to the carrier sheet. The catalyst element is wound to form a plurality of layers, and the inner and the outer peripheries of the wound catalyst are covered with gauze wires 8*a*, 8*b*, so as to form the wound catalyst element into a tubular or cylindrical body permeable to air. Both axial ends of the main catalyst 7 are supported by respective end plates 5*a*, 5*b* which are welded to the communication pipe 5.

The outer gauze wire 8*a* is extended in both axial directions to surround the end plates 5*a*, 5*b*, and pressed onto the periphery of the end plates by means of a metal band 8*c* at each axial end. These metal bands are welded, along with the associated ends of the outer gauze wire 8*a*, to respective end plates 5*a*, 5*b*, thereby to fix the main catalyst 7 onto the communication pipe 5. A conical member 9 is provided at the end of the communication pipe 5, so as to close the end opening of the latter and so as not to cause the reflection of the pressure wave. The conical member 9 is disposed coaxially with the main catalyst 7 and the communication pipe 5, with its apex directed to the upstream side, and has a bottom portion of a diameter substantially equal to that of the end plate. At the same time, a gas accumulation space communicating the communication pipe 5 is formed within the conical member 9.

An auxiliary catalyst 10 of a construction similar to that of the main catalyst 7 is provided on the inner peripheral wall of the outer pipe 1 at the fore side end of the latter. In addition for a better heat preserving effect, the fore side portion of the outer pipe 1 is constituted by a double wall structure.

In the first embodiment of the invention having the described construction, no deterioration of reflection of the pressure wave is caused, because the main catalyst 7 is disposed along the wall of the communication pipe 5, so that the engine performance is never affected adversely.

At the same time, since the main catalyst 7 is located forward of the reflecting wall in the expansion chamber 3, so as to contact hot exhaust gas which has not been sent to the silencer chamber 4, the main catalyst can be activated sufficiently. The auxiliary catalyst 10 causes the reaction of the exhaust gas while the latter is hot enough, so as to heat up the exhaust gas, thereby to ensure a sufficiently high temperature of the exhaust gas while it flows down to the main catalyst 7. The auxiliary catalyst 10 is also effective in shortening the time required for activating the main catalyst 7, soon after the cold start of the engine.

It is to be noted here that the scope of the invention is by no means restricted to the above described first embodiment.

Figure 2:
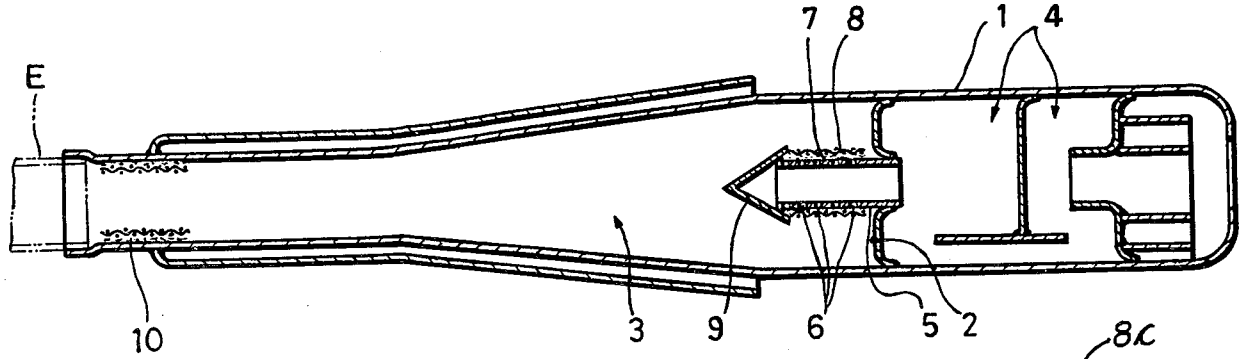
FIG. 2 is an axial cross-section of a modification of the embodiment of FIG. 1.

For instance, the communication pipe 5 need not be projected into the silencer chamber as shown in FIG. 2, and need not be projected into the expansion chamber although such a modification is not illustrated. Namely, the communication pipe 5 may be formed as a mere communication bore.

The modification as shown in FIG. 2 has the same construction as the described first embodiment, except that pipe 5 projects a lesser distance into expansion chamber 3, and not at all into chamber 4. In FIG. 2, those parts corresponding to those of FIG. 1 are denoted by the same reference numerals, so that further description will not be needed here.

The scope of the invention is not restricted even by the above stated modification. For instance, the auxiliary catalyst can be dispensed with.

As has been described, there is provided, according to the invention, an exhaust silencer having a reflection chamber at its intermediate portion, the space at the fore side of the reflecting wall being formed into an expansion chamber connected to the exhaust pipe, while the rear portion is formed into a silencer chamber, the expansion chamber and the silencer chamber communicating with each other through a communication passage, and a catalyst for causing the reaction of the exhaust gas disposed along the wall of the communication passage.

Consequently, no bad effect on the engine performance attributable to the deterioration of the reflection of the pressure wave can take place. At the same time, since the hot gas can contact the catalyst before entering the silencer chamber, the catalyst can sufficiently be activated.

The invention is not to be limited by the embodiments shown in the drawings and described in the description which are given by way of example and not of limitation, but only in accordance with the scope of the appended claims.

We claim:

1. An exhaust silencer having an axis, comprising: an axially extending expansion chamber having an opening disposed on said axis which is adapted to be connected to an exhaust pipe to receive exhaust gases from an engine, said expansion chamber being enlarged laterally downstream from said opening, a reflecting wall extending normally to the axis and forming part of the boundary of said expansion chamber to reflect sound waves incident thereon back into the expansion chamber; an axially extending silencer chamber including means for silencing sound waves in a stream of said exhaust gases, said silencer chamber having an exit port; axially extending passage means forming a passage interconnecting said expansion chamber and said silencer chamber, said passage means projecting forwardly and axially from said reflecting wall into said expansion chamber and having an outer wall disposed in said expansion chamber and having an internal passage and perforations through said outer wall into said passage, said perforations being axially spaced from said reflecting wall; and a catalyst supported on said outer wall and covering said perforations, in the path of flow of exhaust gases from the expansion chamber to the exhaust chamber through which the exhaust gases pass while flowing from the expansion chamber to the silencing chamber, said expansion chamber, except for said passage means and the wall forming the boundaries of said expansion chamber, being devoid of structure which would change the direction of gases which pass from the opening to said perforations.

2. An exhaust silencer according to claim 1 in which the expansion chamber has a peripheral wall and in which said peripheral wall, adjacent to said opening, carries a catalyst exposed to exhaust gas entering said expansion chamber.

3. An exhaust silencer according to claim 1 in which a shroud member extends around at least a portion of the outside of the expansion chamber, and spaced therefrom, to provide an insulating space therebetween.

* * * * *